US005761777A

United States Patent [19]

Leick

[11] Patent Number: 5,761,777

[45] Date of Patent: Jun. 9, 1998

[54] GUIDE DEVICE FOR BOOT LACE

[75] Inventor: Patrick Leick, Villaz, France

[73] Assignee: Salomon S.A., Annecy, Cedex, France

[21] Appl. No.: 576,085

[22] Filed: Dec. 21, 1995

[30] Foreign Application Priority Data

Dec. 23, 1994 [FR] France ..... 9415819

[51] Int. Cl.[6] ..... A43C 1/00

[52] U.S. Cl. ..... 24/714.6; 24/713.5; 24/713.6

[58] Field of Search ..... 24/714.6, 714.8, 24/714.7, 715, 713.3, 713.4, 713.5, 713.9, 713.6, 714.5; 36/50.1

[56] References Cited

U.S. PATENT DOCUMENTS

| | | | |
|---|---|---|---|
| 658,952 | 10/1900 | Kling | 24/714.6 |
| 746,563 | 12/1903 | McMahon | 24/713.5 |
| 816,196 | 3/1906 | Tuttle | 24/713.5 |
| 871,528 | 11/1907 | Senn | 24/713.5 |
| 1,282,539 | 10/1918 | Carlson | 24/713.5 |
| 1,393,188 | 10/1921 | Whiteman | 24/713.5 |
| 5,117,567 | 6/1992 | Berger | 36/50 |

FOREIGN PATENT DOCUMENTS

| | | | |
|---|---|---|---|
| 370 948 | 2/1907 | France . | |
| 0017834 | 12/1913 | France | 24/713.5 |
| 1 349 832 | 3/1963 | France . | |
| 1404799 | 5/1965 | France | 24/713.5 |
| 18 745 | 7/1963 | Germany . | |
| 0051432 | 4/1910 | Switzerland | 24/713.5 |
| 315871 | 10/1956 | Switzerland . | |
| 0443970 | 2/1968 | Switzerland | 24/714.6 |

*Primary Examiner*—Victor N. Sakran
*Attorney, Agent, or Firm*—Pollock, Vande Sande & Priddy

[57] ABSTRACT

The guide device for boot lace is constituted by an outer framework (11) possessing mechanical strength properties and capable of being fastened to the boot upper, and by an insert (12) made of a material having a low coefficient of friction fastened inside the outer jacket (11) and delimiting the path (12*b*) of the lace inside the guide device. This guide device makes it possible, in particular, to reduce the friction generated between the lace and the guide device.

9 Claims, 4 Drawing Sheets

GUIDE DEVICE FOR BOOT LACE

FIELD OF THE INVENTION

The present invention concerns a guide device for boot laces.

BACKGROUND OF THE INVENTION

A boot traditionally comprises a sole and an upper fitted with an opening allowing insertion of the foot and incorporating, on either side of this opening, a series of guide devices for one or several laces designed to enable the opening to be closed when traction is exerted on them.

The guide devices are normally constituted by hooks, but such hooks do not hold the lace in place when the latter is loosened, or buckles through which the laces run, the laces passing in alternating fashion above and below the plane of each buckle.

One major problem posed by all systems incorporating conventional guide devices is the high degree of friction generated between the lace and its guide device, so that simple traction on the free ends of the lace is not sufficient to produce effective tightening along the entire length of the lace, and that traction must be exerted on each section of the lace extending between two guide devices in order to tighten effectively and uniformly the entire lacing area, including the area corresponding to the tip of the foot.

This problem is especially crucial for boots made of a relatively rigid material, for example, hiking boots made of thick leather, or in-line skating boots, which comprise a relatively stiff plastic shell, for which effective tightening is sought up to the tip of the foot.

In fact, this friction problem is exacerbated further by the length of the lacing area required to reach the tip of the foot.

In one hiking boot, sold under the trade name ASOLO, the guide devices are constructed in the form of metal pulleys which are mounted so as to pivot in relation to the upper, in order to solve the problems stated above.

These guide devices undeniably yield an additional advantage, since the pulleys solve the problem of friction.

However, the structure of these devices is complex, fragile, heavy, and costly because of the joints, as well as being highly sensitive to frost and oxidation. In addition, in relation to the upper the pulleys constitute projecting parts that can hinder the user when mountain climbing and, in addition, can be easily damaged and twisted while when engaging in this sport (wedging in fissures, etc.).

SUMMARY OF THE INVENTION

The present invention is intended to solve the problems mentioned above and to supply an improved lace guide device which makes it possible, in particular, to improve the sliding action of the lace, while being strong, light, and inexpensive.

This goal is achieved in the guide device according to the invention by virtue of the fact that it is constituted by an outer framework which has mechanical strength properties and which can be fastened to the boot upper, and by an insert made of a material having a low coefficient of friction and attached inside the outer framework while delimiting the path of the lace.

In fact, this two-part construction makes it possible to lighten the structure appreciably and to reduce manufacturing costs by separating the mechanical strength/sliding functions. Moreover, the stationary construction of the insert increases the resistance of the assembly to stresses, impacts, and, depending on the circumstances, frost.

Advantageously, the passage delimited by the lace insert extends into the lacing plane. This configuration also makes it possible to optimize the sliding action, since the lace thus always remains in the same lacing plane, and thus does not have to pass in alternating fashion on either side of the plane, as it does in conventional structures.

According to another embodiment, the path of the lace is semi-circular and thus acts as a stationary pulley promoting effective sliding action.

BRIEF DESCRIPTION OF THE DRAWINGS

The invention will be better understood and other features thereof will be highlighted by means of the following description provided with reference to the attached drawings which illustrate a preferred embodiment and in which.

DETAILED DESCRIPTION

Figure 1:
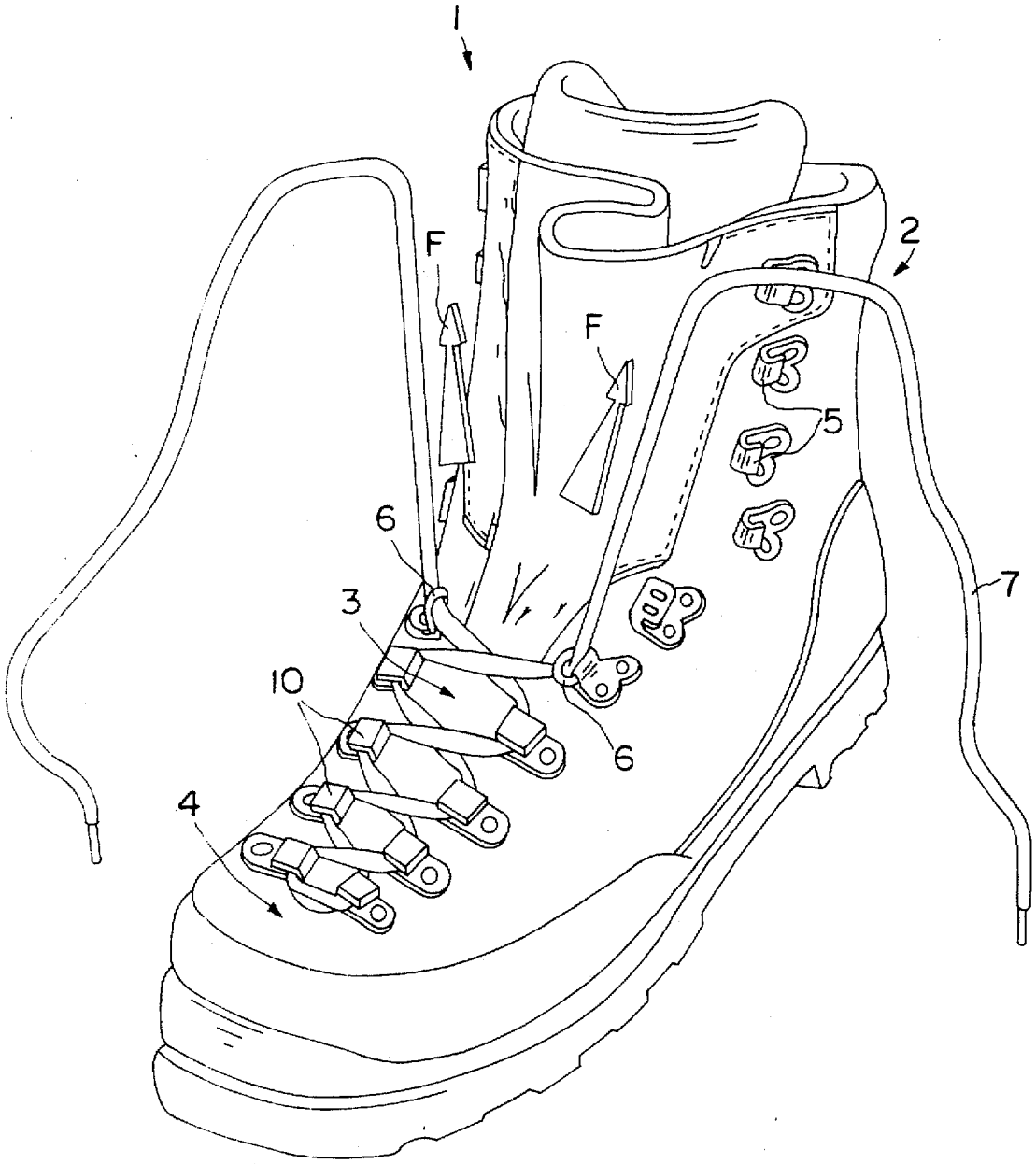
FIG. 1 is a perspective view of a boot using the guide devices according to the invention.

FIG. 1 represents a hiking boot 1 in which the upper 2, which is shown closed, is fitted with an "opening" 3, in the boot shown as bellows, extending to the tip 4 of the boot, this opening 3 being bordered on either side by a series of hooks 5, loops 6, and guide devices 10 according to the invention.

Figure 3:
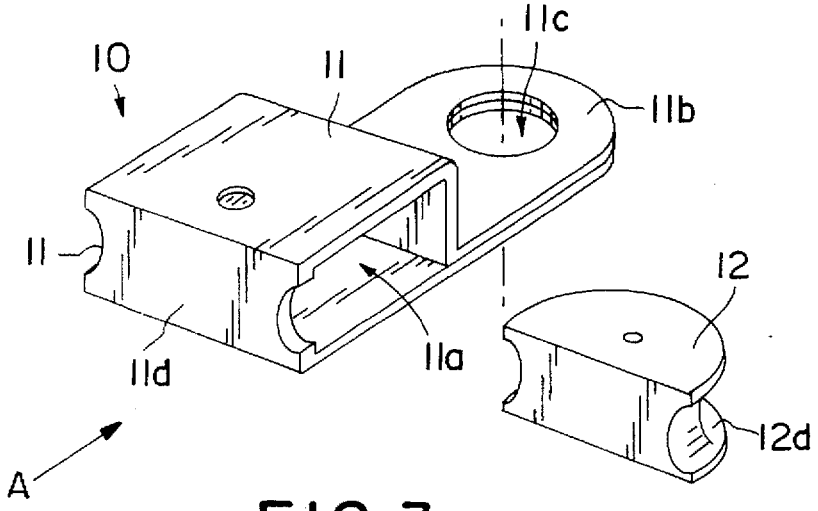
FIG. 3 is an exploded perspective view of a guide device according to the invention.
Figure 4:
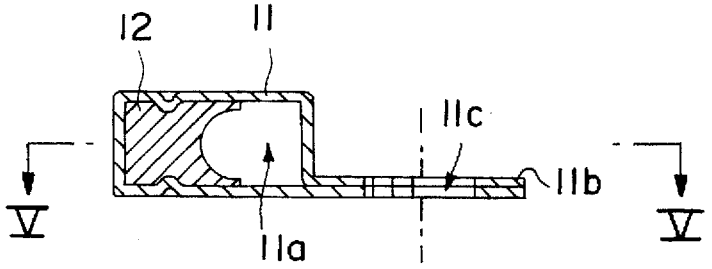
FIG. 4 is a longitudinal cross-section of the guide device in FIG. 2.
Figure 5:
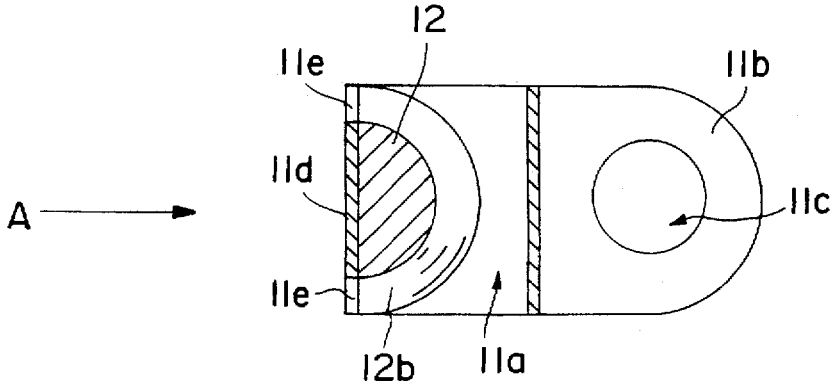
FIG. 5 is a cross-section along line V—V in FIG. 4.

As illustrated in FIGS. 3, 4, and 5, each guide device 10 is constituted an outer jacket, or framework 11 and by an insert 12.

In the example shown, the outer is constituted by a single piece of sheet brass or steel cut out and folded so as to delimit a housing 11*a* having a rectangular transverse section, and a fastening tab 11*b* having a hole 11*c* designed for attachment, for example by means of a rivet, to the boot upper. Instead of a closed structure of this kind, the outer framework 11 could also have an open hook shape, provided that it possesses the requisite mechanical strength. These hooks may then be advantageously used in place of the hooks 5 at the top of the upper.

As shown in FIGS. 3 and 5, two semi-circular recesses lie may also be provided in the rear wall 11*d* of the housing 11 to allow passage of the lace 7.

The insert 12 has the shape of a half-pulley fitted with a peripheral semi-circular groove 12*b* .

As shown in FIG. 5, the depth of the groove 12*b* matches that of the semi-circular recesses 11*e* of the outer framework 11, in such a way as to avoid creating a discontinuity between the insert and the outer framework thereof for the lace, when the latter reaches the guide device, and to generate minimal friction between the lace and the guide device. It is also possible to give a progressive profile to the groove 12*b* in order to be able to remove the recesses 11*e* , without, however, hindering passage of the lace and in order to simplify the equipment. The depth of the groove 12*b* and of the recesses lie is, moreover, determined as a function of the diameter or width of the lace 7.

The insert 12 is made of a material having a low coefficient of friction, for example polyamide, polyurethane, or Delrin.

Delrin is the material of choice for use at low temperatures, since it is strong at those temperatures.

Of course, the material is selected, depending on the case, in conjunction with the material used for the lace, in order to obtain a guide device/lace pairing having a minimal coefficient of friction.

Depending on the specific use, the insert 12 may be covered with a coating which improves sliding properties still further, for example the coating known by the trade name teflon.

As shown in FIGS. 3 to 5, the insert 12 may be fastened to the inside of the framework 11 by crimping or by any other connection means available to the workman, e.g., rivetting, screwing, etc.

As shown more particularly in FIGS. 2 to 7, the guide devices 10 make it possible to delimit a path for the lace 7 always falling within the same plane P, which corresponds to the median plane of the groove 11*e*; that is, without travelling from one side of this plane P to the other.

Figure 6:
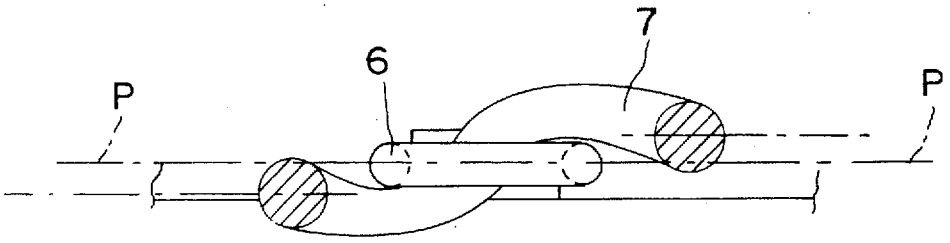
FIG. 6 PRIOR ART
FIG. 6 is a side view of a passage loop according to the prior art showing the path of the lace delimited in conjunction with this loop.
Figure 7:
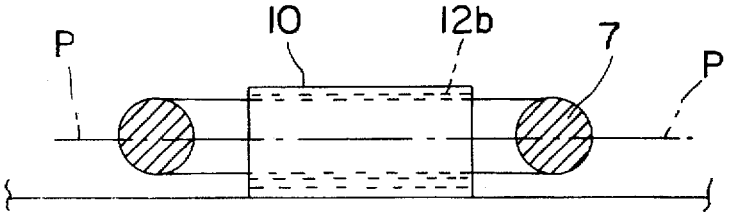
FIG. 7 is a view similar to FIG. 6, showing the path of a lace in a guide device according to the invention.

In this way, the generation of additional interference friction is avoided between the body of the guide device/loop and the lace 7, which travels in alternating fashion from one side of the plane P to the other, as occurs in prior art arrangements using loops 6, as shown in FIG. 6.

Figure 2:
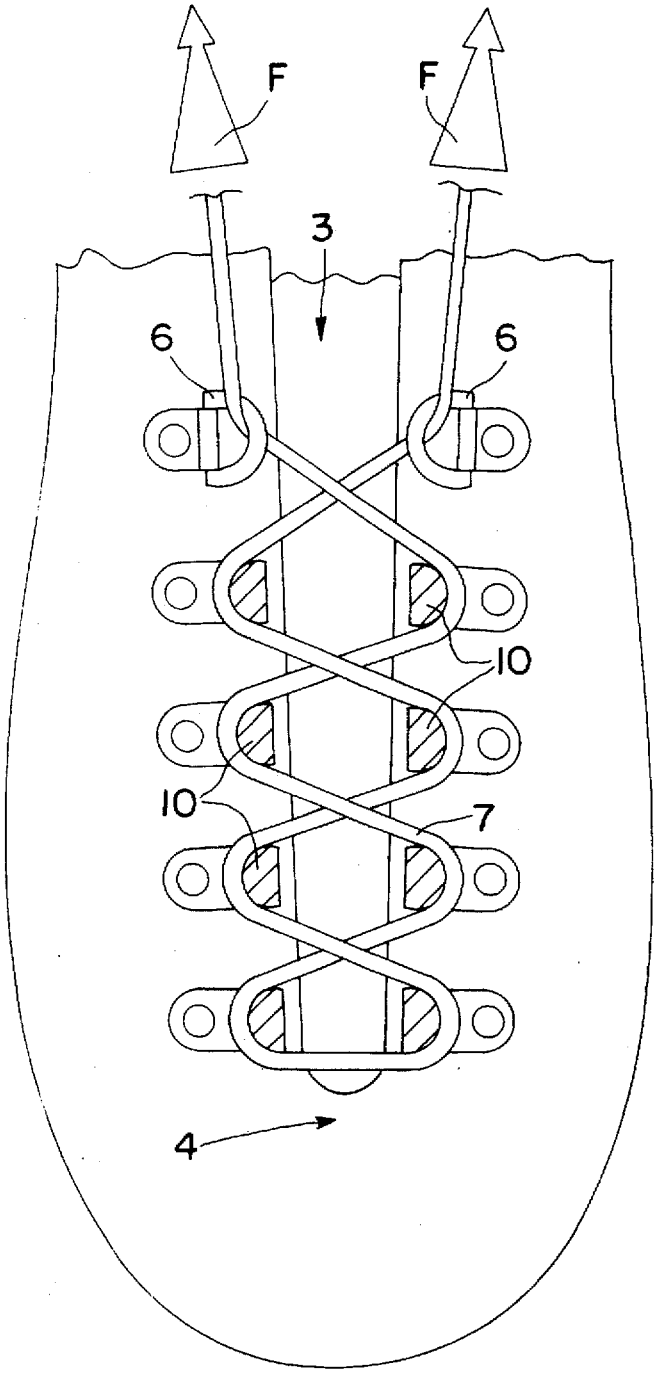
FIG. 2 is a top plan view of the lacing in FIG. 1.

FIG. 2 explains the specific role of the conventional loops 6 used at the front end of the lacing portion constituted by the guide devices 10 according to the invention.

Loops 6 serve to deflect or send back into the substantially "horizontal" lacing plane P delimited by the guide Figures 1 and 2, this stress being exerted on the lace 7 in an essentially vertical direction.

The guide device structure according to the invention allows effective tightening extending to the area of the boot tip 4, whatever the rigidity of the material used for the upper, because of the improved sliding action of the lace on the guide devices produced by virtue of the construction thereof.

The bellow "opening" 3 could be formed as a conventional opening.

Similarly, the upper could be made of a plastic material, fabric etc, or the boot could be an ice-skating boot or a boot incorporating wheels, while still remaining within the scope of the invention.

WHAT IS CLAIMED IS:

1. A guide device for lacing for a boot made of rigid material, said guide device consisting of (a) an outer housing framework having mechanical strength characteristics and adapted to be fastened to a boot upper; and (b) an insert made of a material having a low coefficient of friction fixedly and non-rotatably attached to an inside of said outer housing framework and delimiting a pathway for said lacing in a lacing plane "P" inside said guide device.

2. The guide device according to claim 1, wherein said pathway for said lace is substantially semi-circular.

3. The guide device according to claim 1, wherein said insert is made of a syntheic material.

4. The guide device according to claim 3, wherein said insert is supplied with a coating facilitating sliding of said lace.

5. The guide device according to claim 3, wherein said outer framework is metallic.

6. The guide device according to claim 3, wherein said insert is crimped inside said outer framework.

7. The guide device according to claim 1, wherein said outer framework has a closed structure.

8. The guide device according to claim 1, wherein said outer framework has substantially hook-shaped.

9. The guide device according to claim 1, wherein said outer framework comprises at least recess corresponding to said pathway.

* * * * *

UNITED STATES PATENT AND TRADEMARK OFFICE

CERTIFICATE OF CORRECTION

PATENT NO. : 5,761,777
DATED : June 9, 1998
INVENTOR(S) : Patrick Leick

It is certified that error appears in the above-identified patent and that said Letters Patent is hereby corrected as shown below:

Claim 3,
Line 2, change "syntheic" to --synthetic--.

Claim 8,
Line 2, change "has" to --is--.

Claim 9,
Line 2, after "least" insert --one--.

Signed and Sealed this

First Day of December, 1998

Bruce Lehman

*Attest:*

BRUCE LEHMAN

*Attesting Officer*

*Commissioner of Patents and Trademarks*